US007237857B2

(12) United States Patent
Chang

(10) Patent No.: US 7,237,857 B2
(45) Date of Patent: Jul. 3, 2007

(54) IMAGE FORMING APPARATUS CAPABLE OF PRINTING DISC AND DISC-PRINTING UNIT FOR THE IMAGE FORMING APPARATUS

(75) Inventor: Deuk-hwan Chang, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 354 days.

(21) Appl. No.: 10/831,211

(22) Filed: Apr. 26, 2004

(65) Prior Publication Data

US 2004/0223030 A1 Nov. 11, 2004

(30) Foreign Application Priority Data

May 9, 2003 (KR) ..... 10-2003-0029403

(51) Int. Cl.
*B41J 3/00* (2006.01)
*B41J 2/01* (2006.01)

(52) U.S. Cl. ..... 347/2; 347/104

(58) Field of Classification Search ..... 347/2, 347/4, 16, 101, 104
See application file for complete search history.

(56) References Cited

U.S. PATENT DOCUMENTS 3,678,193 A * 7/1972 Yamamoto ..... 178/18.01
5,927,208 A * 7/1999 Hagstrom et al. ..... 101/486
6,264,295 B1 7/2001 Bradshaw et al.
6,478,485 B1 * 11/2002 Niestrath ..... 400/120.07
6,709,175 B1 * 3/2004 Drynkin et al. ..... 400/48
6,896,363 B2 * 5/2005 Oshima et al. ..... 347/104
2002/0030705 A1 * 3/2002 Youngberg et al. ..... 347/2
2002/0067940 A1 * 6/2002 Sasai et al. ..... 400/61
2004/0052564 A1 3/2004 Fujita

FOREIGN PATENT DOCUMENTS

| | | |
|---|---|---|
| EP | 1190857 | 3/2002 |
| JP | 9-265760 | 10/1997 |
| JP | 2000-71525 | 3/2000 |
| JP | 2002-269843 | 9/2002 |
| JP | 2002-326398 | 11/2002 |
| WO | 99/52713 | 10/1999 |
| WO | 00/32399 | 6/2000 |

* cited by examiner

*Primary Examiner*—Stephen Meier
*Assistant Examiner*—Leonard Liang
(74) *Attorney, Agent, or Firm*—Staas & Halsey LLP

(57) ABSTRACT

An image forming apparatus that is capable of printing a disc and includes a disc-printing unit. The image forming apparatus includes a carrier having a print head, wherein the carrier is reciprocatingly set in a body of the image forming apparatus, a driving motor to provide a rotational driving force to at least one roller set in the body of the image forming apparatus to transfer a print paper, and a disc-printing unit, in which a disc is rotatably seated within a moving area of the carrier; wherein the disc-printing unit rotates the disc by a driving force of the driving motor during a printing operation.

9 Claims, 7 Drawing Sheets

IMAGE FORMING APPARATUS CAPABLE OF PRINTING DISC AND DISC-PRINTING UNIT FOR THE IMAGE FORMING APPARATUS

CROSS-REFERENCE TO RELATED APPLICATIONS

This application claims the benefit of Korean patent Application No. 2003-29403, dated May 9, 2003, in the Korean Intellectual Property Office, the disclosure of which is incorporated herein by reference.

BACKGROUND OF THE INVENTION

1. Field of the Invention

The present invention relates to an image forming apparatus capable of printing a disc and a disc-printing unit for such an image forming apparatus, and more particularly, to an image forming apparatus having a printing function for printing a title, a design, or the like on a surface of the disc and a disc-printing unit that is applied to such an image forming apparatus.

2. Description of the Related Art

Recently, various types of storage media have appeared in the market, among which discs are largely used in general because they are inexpensive and conveniently portable. Descriptions, such as words, letters, characters, symbols, communications, etc., directly describing a title, an outline, or the like, are often written or formed on the surfaces of discs, so that the contents stored in the discs can be easily determined or known. However, these descriptions, usually made by hand using a pen or the like, are problem-some in that the descriptions may easily be erased, and in particular, the quality of external appearance of the discs may be compromised by the description.

Recently there has been proposed a disc-printing unit as shown in FIG. 1 (see Japanese Patent Publication No. JP 9-265760), which can print contents or patterns designed by consumers on surfaces of discs. As can be seen from FIG. 1, the conventional disc-printing unit 100 comprises a turntable 110, on which a disc 1 is seated, a rotary motor 115 for rotating the turntable 110, and a printing head 120 located above the turntable 110. The printing head 120 is moved and guided in the radial direction of the turntable 110 by a guide rod 121 that is driven by a moving motor 125. The disc-printing unit 100 further comprises an optical head 130 for illuminating a laser beam to the disc 1 in order to reproduce information stored in the disc 1, an optical head driving motor 135, and an optical head guide rod 131.

With this conventional construction, if a signal corresponding to a print image is applied from the outside, a control section converts the print image into a dot image of a polar coordinate format about a rotational axis of the turntable 110. Then, the moving motor 125 is controlled by the control section on the basis of the converted dot image, such that the printing head prints the contents or designs on the surface of the disc 1 while being moved in the radial direction of the disc 1. Concurrently, the applied print image can be printed while the driving of the rotary motor 115 and the ink-jet through the print head 120 are intermitted relative to each other.

However, the conventional disc-printing unit 100 is complicated to construct. In particular, the optical head 130 for reading and writing information of a disc 1 and its driving means 131, 135, and a printing head 120 for performing printing on the disc 1 and its driving means 121, 125 need to be installed together within a given space. In addition, a position-detecting sensor must be provided for detecting the position of the printing head 120 on the polar coordinate within a moving area of the printing head 120, and a rotary motor 115 must also be provided. Furthermore, the moving motor 125, the rotary motor 115, and the driving motor 135 must be separately provided. Due to such a complicated construction, the manufacturing costs increase.

Although the conventional disc-printing unit 100 can both read and write information, it would be desirable if the conventional disc-printing unit could be applied to an inexpensive printer, one that prints on a print paper, while simplifying the construction thereof. It is possible to provide an inexpensive printer with a function for printing a disc being added beyond an original printer function, i.e. a function for printing a print paper.

SUMMARY OF THE INVENTION

Additional aspects and/or advantages of the invention will be set forth in part in the description which follows and, in part, will be obvious from the description, or may be learned by practice of the invention.

Accordingly, the present invention has been made to solve the above-mentioned problems occurring in the related art, and an aspect of the present invention provides an image forming apparatus of a simple construction with an additional function capable of printing desired contents or designs on a surface of a disc beyond a function capable of printing a print paper.

Another aspect of the present invention provides a disc-printing unit of a simple construction for an image forming apparatus, wherein the disc-printing unit is capable of being incorporated in an image forming apparatus and is inexpensive in manufacturing and maintenance.

In order to achieve the firstly mentioned aspect, according to the present invention, there is provided an image forming apparatus comprising: a carrier having a print head and reciprocatingly set in a body of the image forming apparatus; a driving motor providing a rotational driving force to at least one roller set in the body of the image forming apparatus to transfer a print paper; and a disc-printing unit, in which a disc is rotatably seated within a moving area of the carrier, wherein the disc-printing unit rotates the disc by a driving force of the driving motor during a printing operation.

In here, the at least one roller includes a feeding roller located below the carrier for feeding the print paper The disc-printing unit comprises: a revolvable platform having a vertical axis and positioned under the carrier at a lateral end area of the feeding roller, in which the disc is seated on the revolvable platform; a power transfer unit to transmit the rotational force of the feeding roller to the revolvable platform, wherein the power transfer unit comprises: a driven gear connected along a vertical axis of the revolvable platform; a driving gear connected to a rotational shaft of the feeding roller; and a clutch unit located between the driving gear and the driven gear to intermittently transmit the rotational force of the driving gear to the driven gear.

A position where the ink cartridge performs printing on the disc may be determined on the basis of an encoding unit for sensing the position of the carrier.

The image forming apparatus having the aforementioned construction is additionally provided with a function for printing desired contents or design on a surface of a disc beyond a function for performing printing on a paper. Therefore, it is possible to design the surface of the disc as desired by a user.

In order to achieve the above aspect, according to the present invention, there is provided a disc-printing unit mounted in an image forming apparatus comprising a carrier capable of being moved and loaded with at least one ink cartridge, at least one feeding roller located below the carrier for feeding a print paper, and a driving motor for rotating the feeding roller, wherein the disc-printing unit comprises: a revolvable platform having a vertical axis and positioned under the carrier at a lateral end area of the feeding roller, in which a disc to be printed is seated on the revolvable platform; and a power transfer unit for transmitting the rotational force of the feeding roller to the revolvable platform.

In one aspect of the invention, the power transfer unit may be simply constructed by comprising: a driven gear connected along the vertical axis of the revolvable platform; a driving gear connected to a rotational shaft of the feeding roller; and a clutch unit intermediated between the driving gear and the driven gear to intermittently transfer the rotational force of the driving gear to the driven gear.

In addition, a position where the ink cartridge performs printing on the disc may be determined on the basis of an encoding unit for detecting the position of the carrier.

The disc-printing unit having the aforementioned construction is very simple in construction. Therefore, it is possible to inexpensively manufacture and incorporate the disc-printing unit into an image forming apparatus. Furthermore, the costs for maintaining and repairing disc-printing unit are very low.

BRIEF DESCRIPTION OF THE DRAWINGS

These and/or other aspects and advantages of the invention will become apparent and more readily appreciated from the following description of the embodiments taken in conjunction with the accompanying drawings in which.

DETAILED DESCRIPTION OF THE PREFERRED EMBODIMENTS

Figure 1:
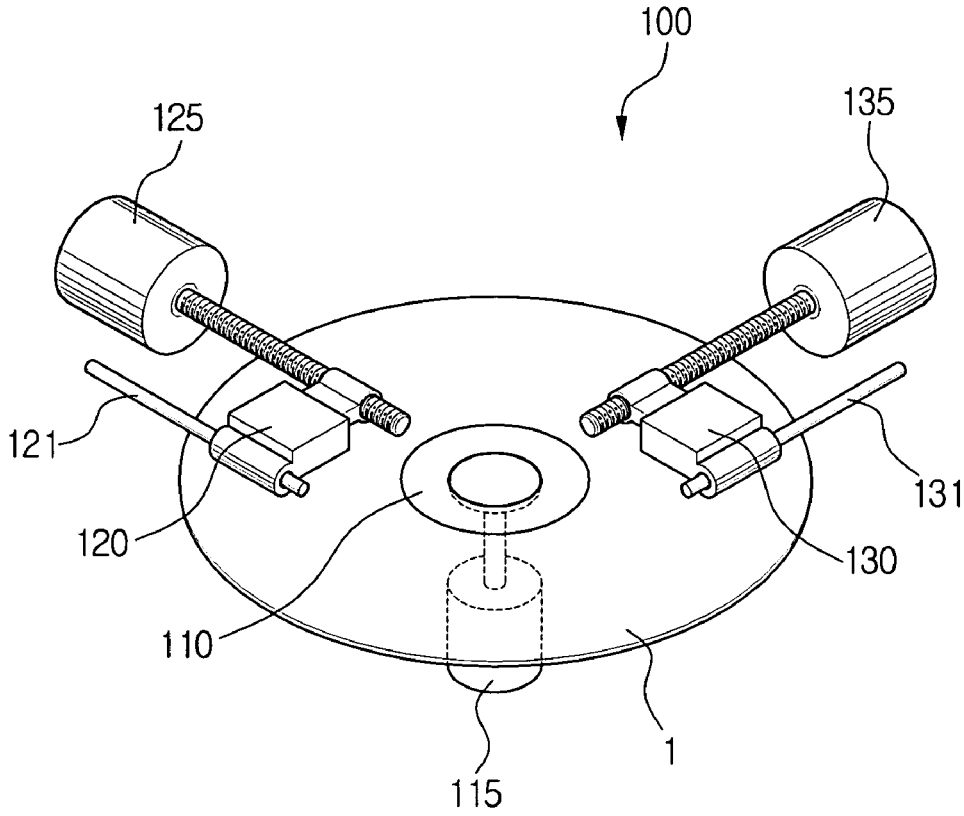
FIG. 1 (PRIOR ART)
FIG. 1 is a perspective view of a conventional disc-printing unit.

Reference will now be made in detail to the embodiments of the present invention, examples of which are illustrated in the accompanying drawings, wherein like reference numerals refer to the like elements throughout. The embodiments are described below to explain the present invention by referring to the figures.

Figure 2:
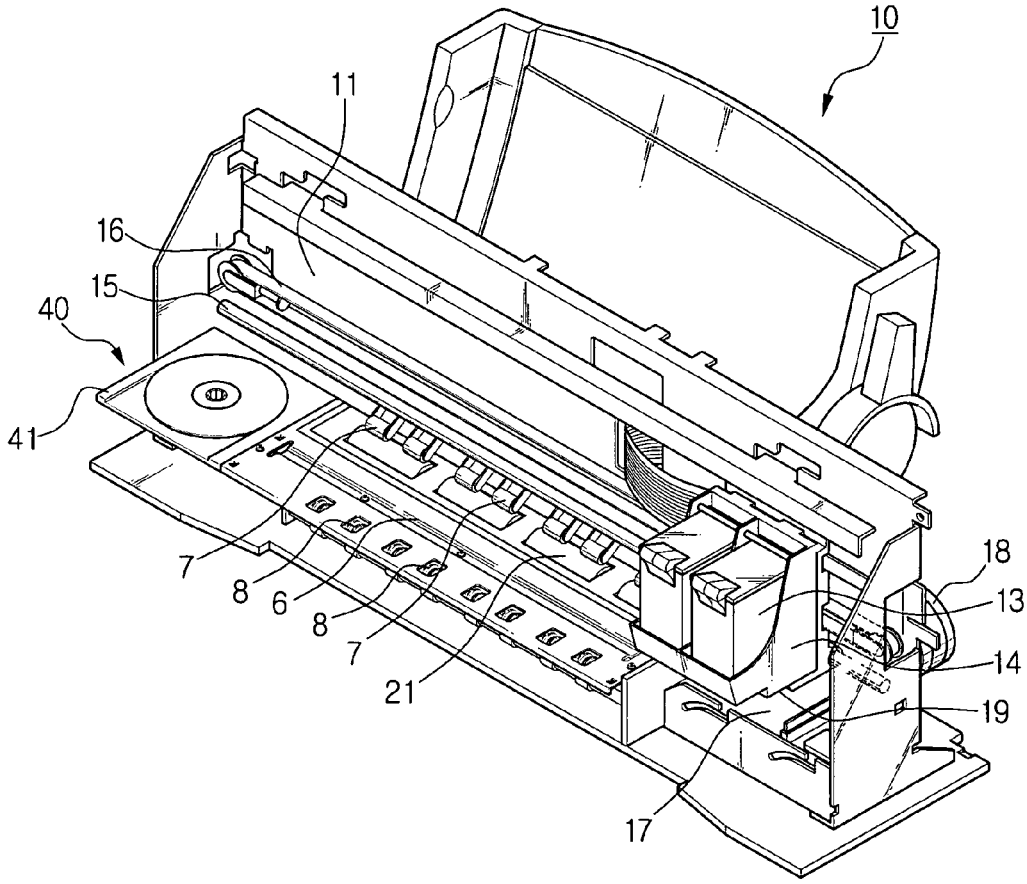
FIG. 2 is a partial perspective view of a printer provided with a disc-printing unit according to the present invention.
Figure 3:
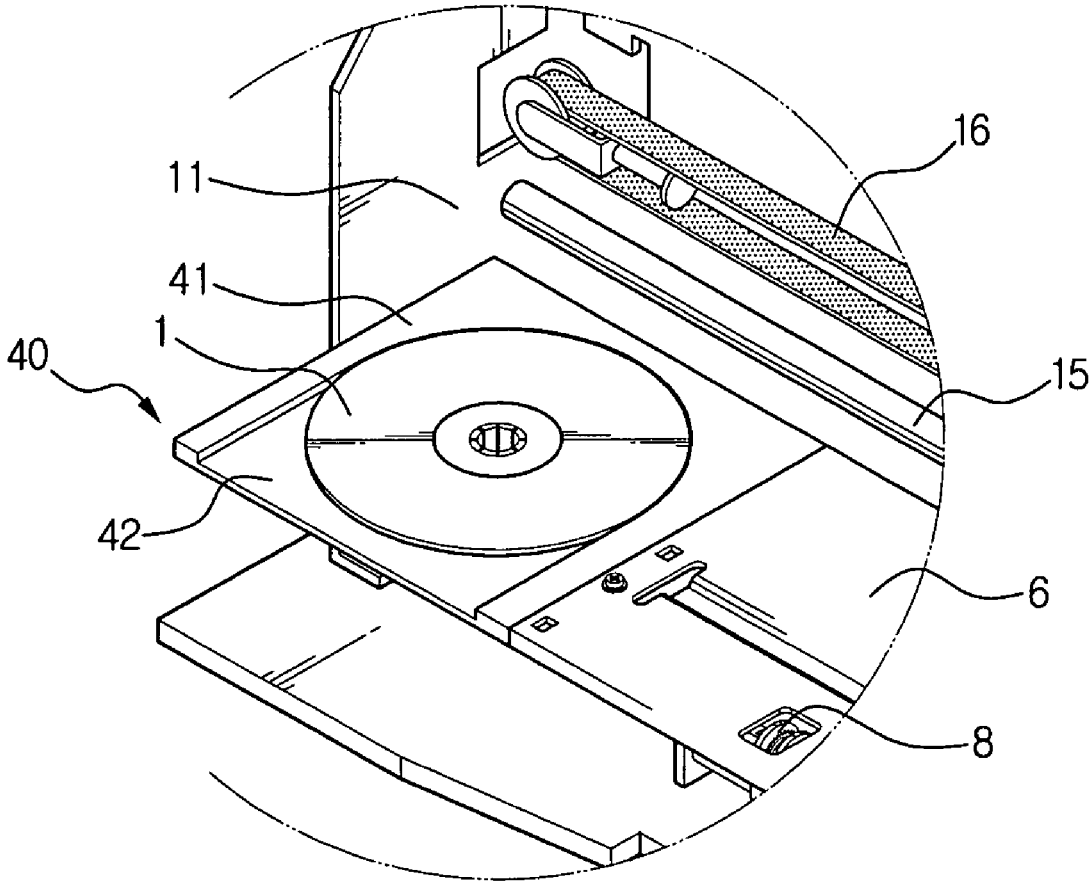
FIG. 3 is an enlarged view of the main part of FIG. 2, in which the construction of the disc-printing unit is depicted in more detail.

FIG. 2 is a perspective view of a printer 10 provided with a disc-printing unit 40 according to the present invention. FIG. 3 is an enlarged view of the disc-printing unit 40 shown in FIG. 2. As can be seen from FIGS. 2 and 3, the image forming apparatus, i.e. the printer 10, includes a carrier 14, at least one feeding roller 21 for feeding a print paper, at least one feeding roller 21 being installed in a central area below the carrier 14, a driving motor 25 for rotating the feeding roller 21, and a disc-printing unit 40 operated by the rotational force of the feeding roller 21. Here, the disc-printing unit 40 is positioned below the carrier 14 and opposite to a maintenance station 17, with the feeding roller positioned between the disc-printing unit 40 and the maintenance station 17.

As in a conventional ink-jet printer, the carrier 14 has a print head 19 positioned at a lower end thereof, and an ink cartridge 13 removably mounted on the carrier 14. The carrier 14 is moved and guided by a guide rod 15 horizontally fixed on a body frame 11 and a time belt 16 installed parallel to the guide rod 15. The guide rod 15 is extended from a position above the disc-printing unit 40 to a position above the maintenance station 17. The time belt 16 reciprocates the carrier 14 within a distance between the position above the disc-printing unit 40 and the position above the maintenance station 17 and is driven by a carrier motor (not shown). In this embodiment, the print head 19 is attached or integrally formed with a lower end of the ink cartridge 13 SO that, when the ink cartridge 13 is mounted in the carrier 14, the print head 19 is exposed from the lower end of the carrier 14. However, this is not limiting. The print head 19 can be integrally formed with the carrier 14 and the ink cartridge 13 can be removably mounted on the carrier 14.

The feeding roller 21 is spaced apart from the ink cartridge 13, loaded in the carrier 14, with a paper-feeding space between the feeding roller 21 and the ink cartridge 13. A paper guide plate 6 is placed within the paper-feeding space to guide the feeding of a print paper. The paper guide plate 6 comprises at least one roller opening to partially expose the feeding roller 21, and at least one pinch roller 7 is provided above the roller openings. The paper guide plate 6 contains at least one roller hole to partially expose at least one paper-discharging roller 8.

A paper cassette (not shown), for stacking and receiving print papers is located underneath the feeding roller 21. The print papers in the paper cassette are picked up by the pickup rollers (not shown) and fed individually to the feeding roller 21. The pickup rollers are driven by the driving force of the driving motor 25 rotating the feeding roller 21. In addition, the print paper fed by the feeding roller 21 is printed with ink ejected from the print head 19, which moves in unison with the carrier 14.

Figure 4:
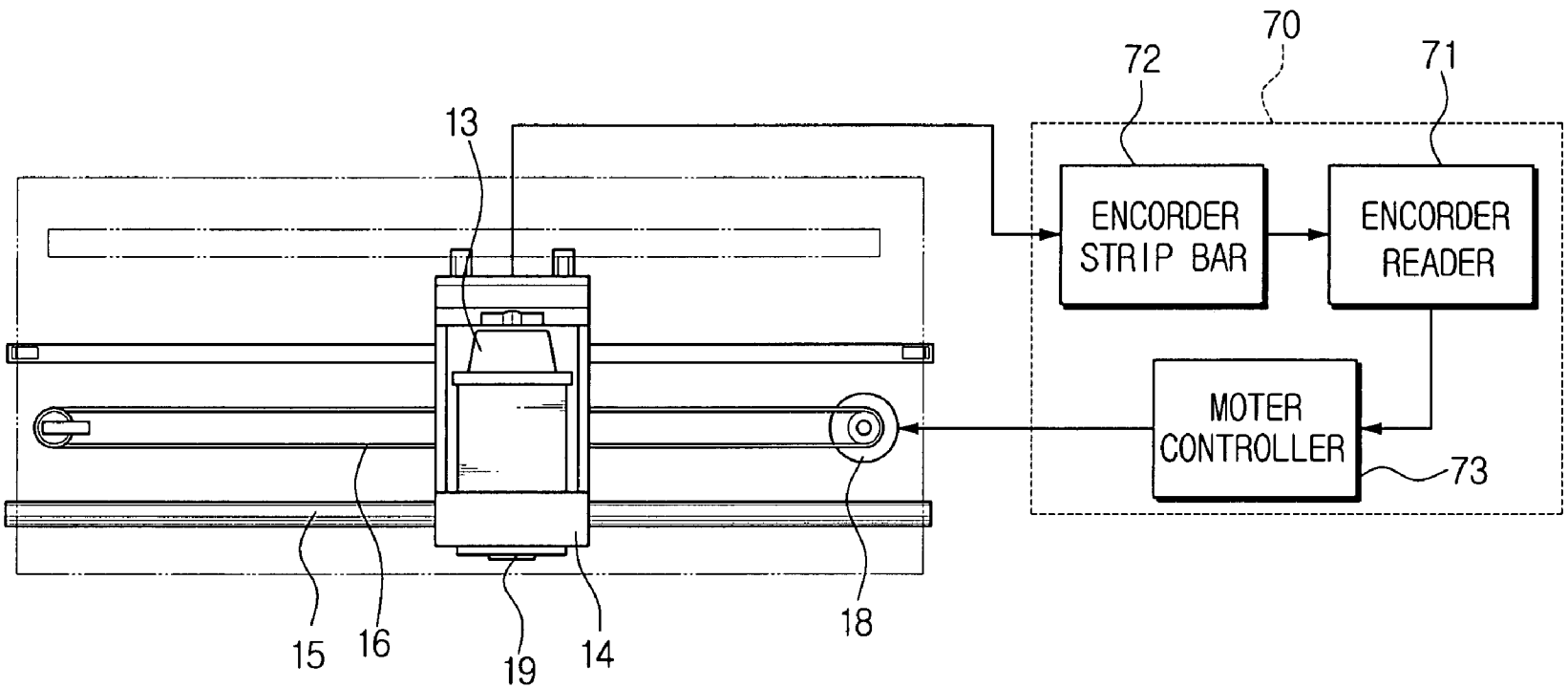
FIG. 4 is a control block diagram of a carrier, in which an encoding unit for controlling the printing position of ink cartridge is indicated, according to the present invention.

The position of the ink cartridge 13 is determined by an encoding unit 70 and a motor controller 73 that controls the operation of the carrier motor 18 on the basis of the detecting signal from the encoding unit 70, as shown in FIG. 4. The encoding unit 70 may consist of an encoder reader 71 formed at a perimeter surface of the carrier 14, and an encoder strip bar 72 provided along the moving direction of the carrier 14. The encoder strip bar 72 is recorded with information relating to the position and moving distance of the carrier 14.

The encoder reader 71 reads and transmits current information of the carrier 14, recorded in the encoder strip bar 72, to the motor controller 73. The motor controller 73 then calculates, or determines, the position, moving velocity or the like of the carrier 14 on the basis of the signal received from the encoder reader 71. Thereafter, the motor controller 73 controls the position, moving velocity, and moving direction of the carrier 14 through the carrier motor 18.

The operational control of the carrier 14 on the basis of the encoding unit 70 may be applied to the ink cartridge loaded in the carrier 14. Because the ink cartridge 13 is loaded in the carrier 14 and the position thereof is fixed in relation to the carrier 14, its position can be easily determined in relation to the position of the carrier 14. Therefore, because the position control of the ink cartridge 13 can be achieved in the same manner as controlling the operation of the carrier 14, a separate position-detecting sensor is not necessary.

Figure 5:
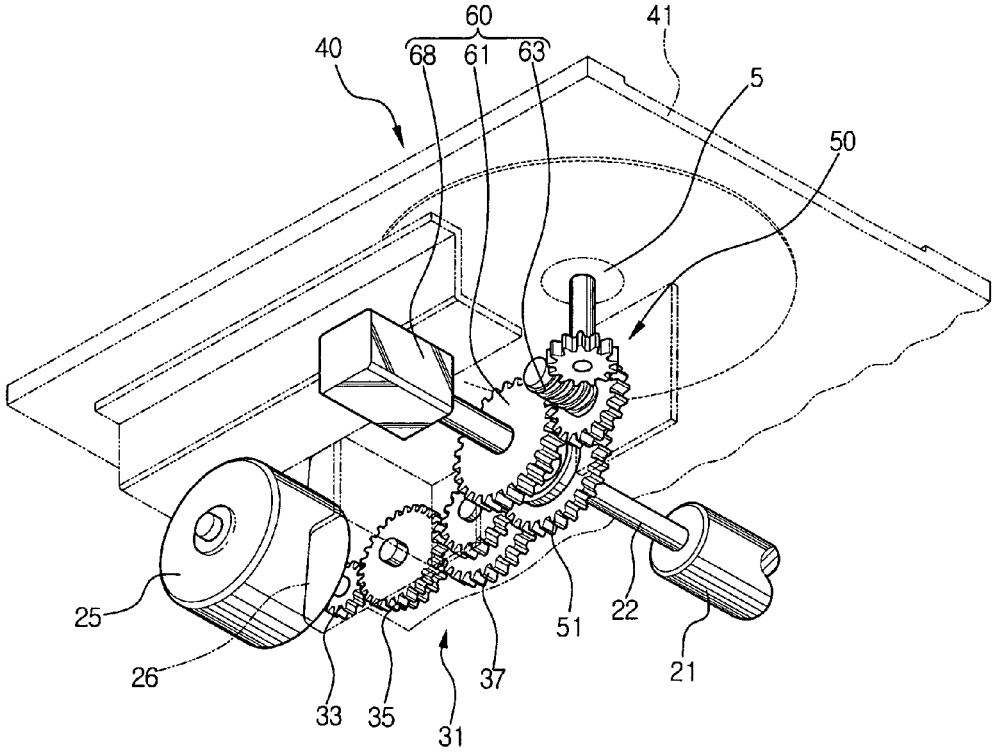
FIG. 5 is a perspective view of the bottom side of FIG. 3.

Meanwhile, the driving motor 25 for driving the feeding roller 21 is attached to a bracket 26 fixed on the rear side of the feeding roller 21, as described in FIG. 5, side. The bracket 26 can be fixed on the bottom side of the printer body 11 by using separate fixing members. It is preferable that the driving motor 25 attached to the bracket 26 consists of a line feed (LF) motor. In addition, a gear train 31 intermediates between the driving motor 25 and the feeding roller 21 to convert the driving force of the driving motor 25 into the rotational force of the feeding roller 21. The driving motor 25 may provide a rotational driving force to the other rollers, such as the paper-discharging rollers driven to transfer the paper, in addition to the feeding roller 21. Since such a driving force transfer is well known to those skilled in the art, a detailed description is omitted.

The gear train 31 comprises a fixed gear 33 connected to the driving shaft of the driving motor 25, a driving gear 51 connected to the rotational shaft 22 of the feeding roller 21, and first and second idle gears 35 and 37 are engaged between the driving motor 25 and the driving gear 51. The idle gears 35 and 37 are rotatably connected to the bracket 26 of the driving motor 26 and a flange extended from the bracket, respectively. With this construction, the driving force of the driving motor 25 is properly decelerated and transmitted to the feeding roller 21.

Figure 6:
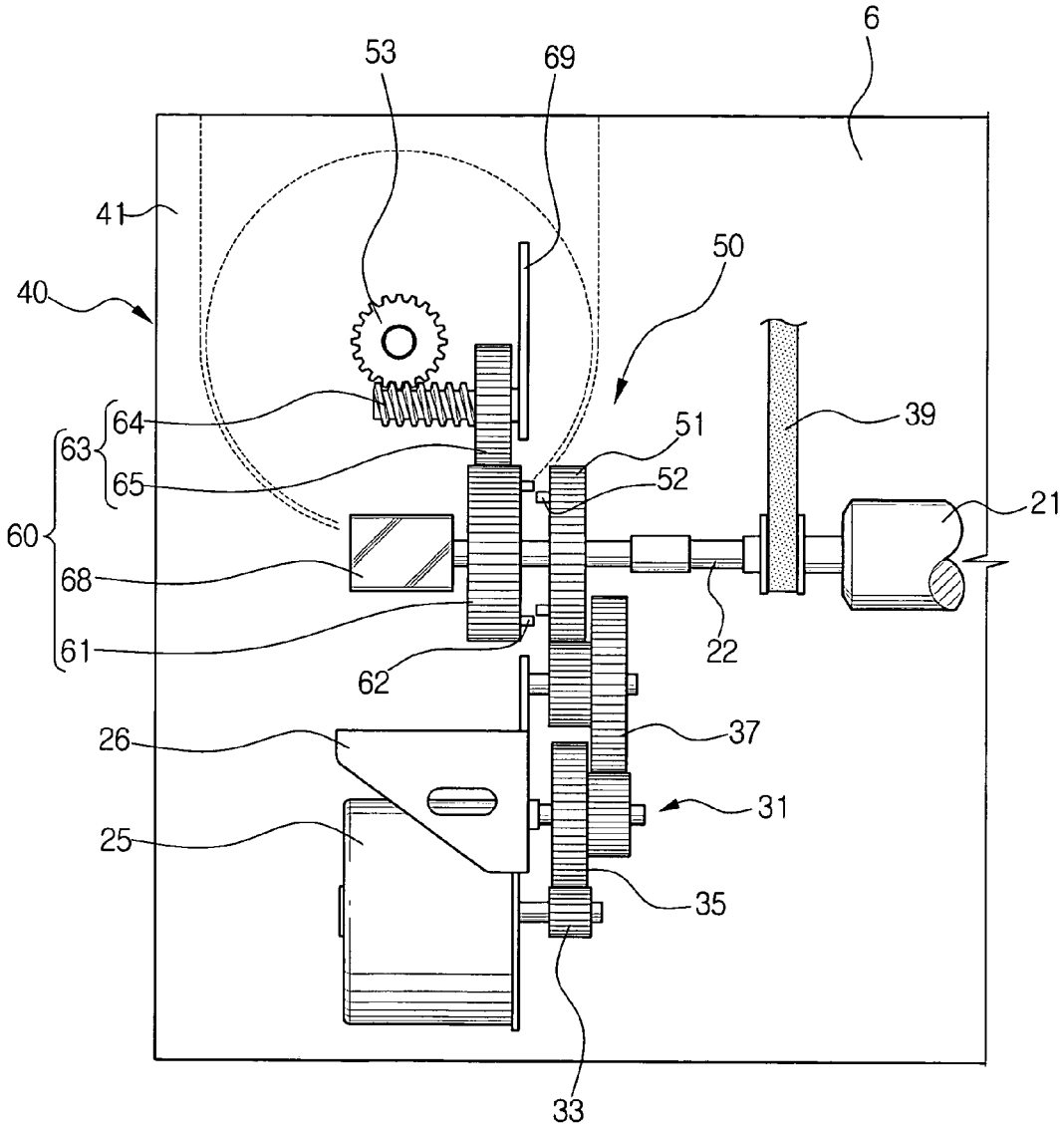
FIG. 6 is a bottom view of FIG. 3.

The gear train 31 further comprises a time belt 39 as shown in FIG. 6, and additional gears for intermitting the operations of pickup rollers. The pickup rollers are for supplying papers loaded in the paper cassette to the feed roller 21 one by one wherein the pickup rollers are operated by the driving force of the driving motor 25. Since constructions of the gear train 31 for driving the feeding roller and pickup rollers are well known to those skilled in the art, a detailed description is omitted.

The maintenance station 17 is a device for protecting and cleaning the print head 19, wherein the print head 19 is loaded in and carried by the carrier 14. When the operation of the printer is interrupted or stopped, the carrier 14 stands by at the position above the maintenance station 17, in which event the maintenance station 17 wipes and caps the print head 19 of the ink cartridge 13, thereby preventing the solidification and adherence of remaining ink or foreign matters. Since the technique related to such a maintenance station 17 is well known to those skilled in the art, a detailed description is omitted.

FIG. 5 is a perspective view of the bottom side of a disc-printing unit according to the present invention, i.e., a disc-printing unit mounted within an image forming apparatus, and FIG. 6 is a bottom view of FIG. 3. The disc-printing unit 40 comprises a revolvable platform 5, such as a rotatable turntable, on which a disc is set, and a power transfer unit 50 for transferring the rotational force of the feeding roller 21 to the revolvable platform 5.

The revolvable platform 5 is horizontally located below the carrier 14 and is capable of rotating about its vertical axis. Between the revolvable platform 5 and the ink cartridge 13 loaded in the carrier 14, there is a disc-receiving space that corresponds to the paper-feeding space provided between the feeding roller 21 and the ink cartridge 13. The disc 1 is introduced into the disc-receiving space and set on the top of the revolvable platform 5. As such, printing is performed on the surface of the disc with ink released from the print head 19 loaded in the carrier 14.

Preferably, a base 41 is provided within the disc-receiving space to support the revolvable platform 5. More preferably, a guide groove 42 for guiding the insertion and removal of the disc 1 is formed on the base 41 in which the guide groove 42 is recessed from the surface of the base 41. Such a base 41 may be simply integrated with the paper guide plate 6.

The power transfer unit 50 includes a driving gear 51 connected to the rotational shaft 22 of the feeding roller 21, a driven gear 53 downwardly connected to the vertical rotation axis of the revolvable platform 5, and a clutch unit 60 intermittently transmitting the rotational force of the driving gear 51 to the driven gear 53. Here, the driven gear 53 may be simply formed of a worm wheel. And, the driving gear 51 is connected to be rotatable integrally with the rotational shaft 22 of the feeding roller 21 and the driving gear 51 is provided with a plurality of projections 52 externally projected in the direction opposite to the feeding roller 21.

The clutch unit 60 comprises a clutch gear 61 connected to the rotational shaft 22 opposite to the driving gear 51, a solenoid device 68 for moving the clutch gear 61 between an engagement position, where the clutch gear 61 is engaged with the driving gear 51, and a disengagement position, where the clutch gear 61 is released from the engagement with the driving gear 51, and an intermediate gear 63, one end of which is engaged with the clutch gear 61 and the other end of which is engaged with the driven gear 53 of the revolvable platform 5. The clutch gear 61 is provided with a plurality of second projections 62 to be engaged with a first projections 52 of the driving gear 51.

The intermediate gear 63 is rotatably attached to a fixed rib 69 installed on the bottom surface of the base 41 and downwardly projected from the bottom surface. The intermediate gear 63 is divided into a worm part 64 that is parallel to the rotational shaft 22 of the feeding roller 21, and a gear part 65 outwardly extended in the radial direction from one end of the worm part 64. The worm part 64 is engaged with the driven gear 53, i.e., a worm wheel of the revolvable platform 5, and the gear part 65 is engaged with the clutch gear 61. With this construction, if the clutch gear 61 and the driving gear 51 are engaged with each other, the driving force of the driving gear 51 is transmitted to the driven gear 53 through the clutch gear 61 and the intermediate gear 63.

Meanwhile, the solenoid device 68 is attached to the bottom surface of the base 41, between the driven gear 53 and the driving motor 25. An actuating rod of the solenoid device 68 moves the clutch gear 61 between the engagement position and disengagement position with respect to the driving gear 51. The operation of the solenoid device 68 is controlled by a control section, which is not shown in the drawings.

In order to perform printing using the disc-printing unit 40, a disc 1 is set in the disc-receiving space, oriented so that the surface to be printed is faced toward the printing head of the ink cartridge 13. If a signal related to a print image is applied, the control section positions the carrier 14 above the disc-printing unit 40. At this time, the position of the carrier 14 is detected through the encoder strip bar 72 and the encoder reader 71 of the encoding unit 70.

If the position of the carrier 14 is established, the control section operates the solenoid device 68 and causes the clutch gear 61 to be engaged with the driving gear 51. When the driving gear 25 is driven, the driving force transmitted through the gear train 31 rotates the feeding roller 21. Concurrently, the rotational force of the feeding roller 21 is transmitted to the driven gear 54, i.e., the worm wheel through the driving gear 51, the clutch gear 61, and the intermediate gear 63, and thus the revolvable platform 5 rotates about its vertical axis. At this time, the disc 1 set on top of the revolvable platform 5 is rotates in unison with the revolvable platform 5.

Then, the control section causes ink to be ejected through the print head 15 of the ink cartridge 13 loaded in the carrier 14, so that the surface of the disc is printed with a print image. The position of the ink cartridge 13 for printing is capable of being detected by the encoding unit 70 that detected the position of the carrier 14. Therefore, the motor controller 73 controls the operation of the carrier motor 18.

Following this, once the position of the ink cartridge 13 is detected, the control section causes the ink ejected from the print head 19 to be properly intermitted while rotating the disc 1. The print image is printed on the surface of the disc 1, in a circumferential direction.

The printing of the print image can be performed while moving the ink cartridge 13 concurrently with rotating the disc 1. Because the encoding unit 70 can detect the displacement of the ink cartridge 13, it is possible to control the position of the ink cartridge 13 through the encoding unit 70 and the motor controller 73. Such a printing method is advantageous in that the printing can be rapidly performed along the circumferential and radial directions of the surface of the disc 1.

Although a disc-printing unit 40 is illustrated in the embodiments described above, as having a clutch unit 60 capable of controlling the rotational force of feeding roller 21, the clutch unit may be omitted.

Figure 7:
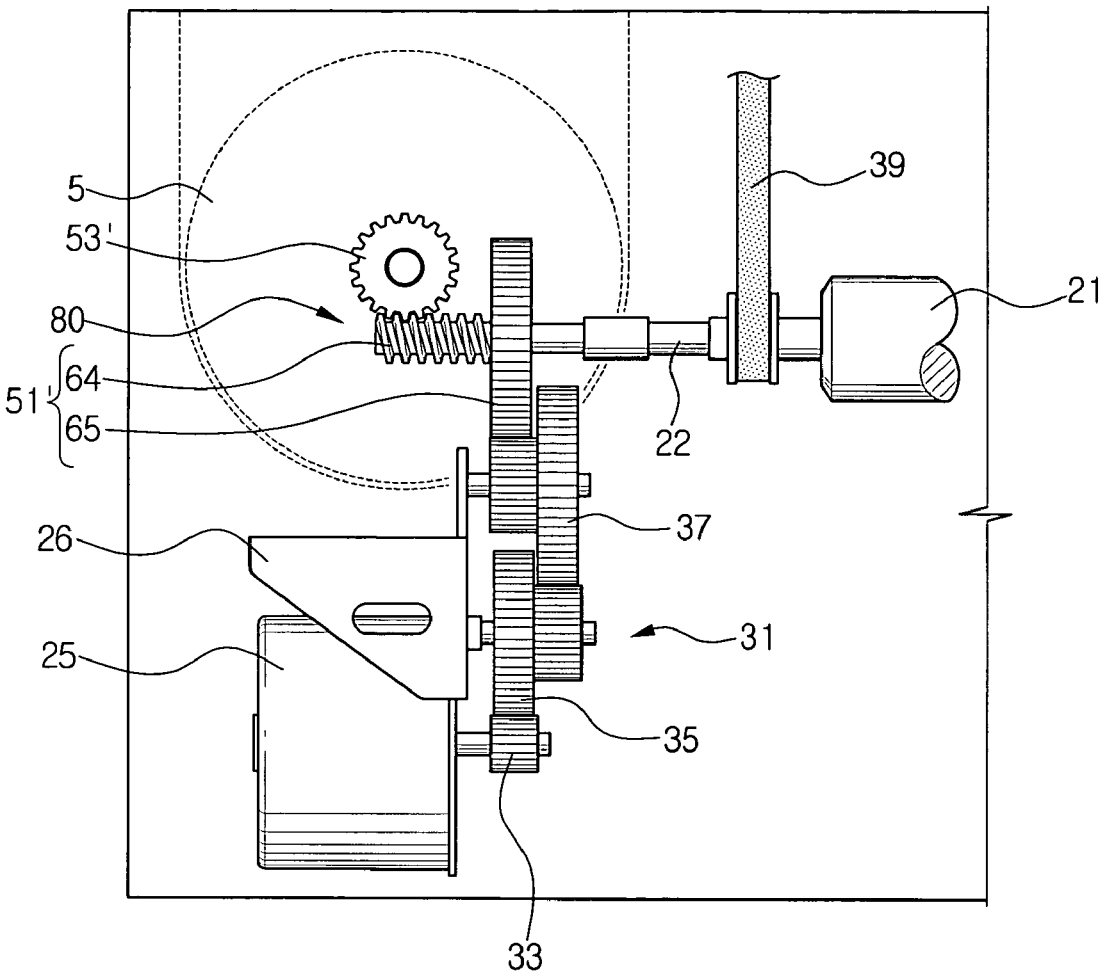
FIG. 7 is a bottom view of a disc-printing unit according to the present invention.

FIG. 7 describes a disc-printing unit 80 according to another embodiment of the present, in which the clutch unit is omitted. The disc-printing unit 80 is constructed in such a manner that a driving gear 51' mounted on the rotational shaft 22 of the feeding roller 21 is substituted with the intermediate gear of the aforementioned embodiment.

That is, the driving gear 51' according to the present embodiment consists of a worm part 64 and a gear part 65. Here, the gear part 65 is connected to the second idle gear 37 that transmits the driving force of the driving motor 25. In addition, the worm part 64 is engaged with a worm wheel which is a driven gear 53' connected to the rotary axis of the revolvable platform 5. With this construction, if the feeding roller 21 rotates, the rotational force is transmitted to the revolvable platform 5 through the driving gear 51' and the driven gear 53'.

In the disc-printing unit 80 with this construction, the revolvable platform 5 always rotates when the feeding roller 21 rotates. However, because the construction is simplified as compared to the aforementioned embodiment, the manufacturing cost is reduced.

As described above, the image forming apparatus according to the present invention functions beyond printing on a print paper. It is also capable of printing desired contents or designs on a surface of a disc on.

Because the disc-printing unit is simple in construction and can be incorporated in the image forming apparatus, manufacturing costs and maintenance costs are reduced.

While the present invention is shown and described in connection with a printer and a disc-printing unit mounted in the printer, the present invention is not limited thereto, and it is possible to provide various types of image forming apparatuses and disc-printing units to be mounted in such image forming apparatuses.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An image forming apparatus comprising:

a carrier having a print head; wherein the carrier is reciprocatingly set in a body of the image forming apparatus;

a driving motor to provide a rotational driving force to at least one roller set in the body of the image forming apparatus to transfer a print paper; and a disc-printing unit, in which a disc is rotatably seated within a moving area of the carrier wherein the disc-printing unit rotates the disc by a driving force of the driving motor during a printing operation, wherein the disc-printing unit comprises a revolvable platform having a vertical axis and positioned under the carrier at a lateral end area of the at least one roller, in which the disc is seated on the revolvable platform; and a power transfer unit to transmit the rotational force of the at least one roller to the revolvable platform, wherein the power transfer unit comprises a driven gear connected downwardly along the vertical axis of the revolvable platform; a driving gear connected to a rotational shaft of the at least one roller; and a clutch unit located between the driving gear and the driven gear to intermittently transmit the rotational force of the driving gear to the driven gear, wherein the driven gear is a worm wheel and the driving gear is provided with a plurality of first projections projected along the axial direction of the feeding roller, and wherein the clutch unit comprises an intermediate gear comprising of a worm part located parallel to the rotational shaft of the at least one roller and engaged with the worm wheel, and a gear part extended in the radial direction from an end of the worm part; a clutch gear provided with a plurality of second projections to be engaged with the first projections of the driving gear, in which the clutch gear is movable along the axis of the feeding roller when engaged with the gear part of the intermediate gear; and a solenoid device to move the clutch gear between an engagement position, where the clutch gear is engaged with the driving gear, and a disengagement position, where the clutch gear is released from the engagement with the driving gear.

2. The apparatus according to claim 1, wherein the at least one roller includes a feeding roller located below the carrier for feeding the print paper.

3. The apparatus according to claim 2, wherein the power transfer unit comprises:

a driving gear connected to a rotational shaft of the feeding roller to rotate the driven gear while being cooperated with the feeding roller.

4. The apparatus according to claim 1, wherein an encoding unit detects the position of the carrier and determines the position of the ink cartridge to perform the function of printing on the disc by the encoding unit that detects the position of the carrier.

5. The apparatus according to claim 4, wherein the encoding unit comprises:

an encoder strip bar that is stored with information relating to the position and moving distance of the carrier and is provided along the moving direction of the carrier; and an encoder reader attached to the rear surface of the carrier, in which the encoder reader reads a value stored in the encoder strip bar to detect the position of the carrier.

6. An image forming apparatus having a print head carrier to move about a guide rod and to hold at least one ink cartridge, and a driving motor to provide a rotational driving force to at least one roller of the image forming apparatus, the apparatus comprising:

a print head carrier motor to control the print head carrier; and a disc-printing unit to print on a surface of a disc, wherein the disc printing unit is located within a moving area of the print head carrier and is operated by a driving force of the driving motor, wherein the disc printing unit comprises:

a revolvable platform on which to set a disc in order to perform a printing operation on a surface of the disc with ink released from the print head carrier, a power transfer unit to transmit rotational force of the at least one roller to the revolvable platform, wherein the power transfer unit comprises a clutch unit to intermittently transmit rotational force of the at least one roller to the revolvable platform, the clutch unit including a solenoid device attached to a bottom surface of a base of the revolvable platform to engage and disengage the clutch unit.

7. The image forming apparatus of claim 6, comprising an encoding unit and a motor controller to control the operation of the print head carrier, wherein the encoding unit reads and transmits information of the print head carrier to the motor controller in order to control the operation of the print head carrier through the print head carrier motor.

8. The image forming apparatus of claim 6, wherein the at least one roller of the image forming apparatus is a feeding roller to load a medium for printing an image and operate in unison with the print head carrier.

9. The image forming apparatus of claim 6, wherein the revolvable platform is horizontally located below the print head carrier and rotates about its vertical axis.

* * * * *

UNITED STATES PATENT AND TRADEMARK OFFICE

CERTIFICATE OF CORRECTION

PATENT NO. : 7,237,857 B2
APPLICATION NO. : 10/831211
DATED : July 3, 2007
INVENTOR(S) : Deuk-hwan Chang It is certified that error appears in the above-identified patent and that said Letters Patent is hereby corrected as shown below:

Column 8, Line 57, after “comprises” delete “:”.

Column 9, Line 17, change “disc printing” to --disc-printing--.

Column 9, Line 20, change “disc printing” to --disc-printing--.

Signed and Sealed this

Eleventh Day of December, 2007

JON W. DUDAS
*Director of the United States Patent and Trademark Office*